United States Patent [19]

Guthmann

[11] 4,109,603

[45] Aug. 29, 1978

[54] BOAT MOORING APPARATUS

[76] Inventor: Stephen Franklin Guthmann, 1 Brandon Rd., DeWitt, N.Y. 13214

[21] Appl. No.: 734,290

[22] Filed: Oct. 20, 1976

[51] Int. Cl.[2] ..... B63B 21/00

[52] U.S. Cl. ..... 114/230; 114/218

[58] Field of Search ..... 114/218, 230; 24/115 R, 24/115 C, 115 H, 115 J, 115 K, 115 L, 115 M, 128 R, 129 A, 129 D, 129 R, 130

[56] References Cited

U.S. PATENT DOCUMENTS

| | | | |
|---|---|---|---|
| 1,079,098 | 11/1913 | Beckert | 24/128 R |
| 1,466,495 | 8/1923 | Watson | 24/129 R |
| 1,870,172 | 8/1932 | Buschhaus | 24/128 R |

*Primary Examiner*—Trygve M. Blix
*Assistant Examiner*—Jesus D. Sotelo

[57] ABSTRACT

A Boat Mooring Apparatus, comprising two main units — a Boat Mooring Line Apparatus and a Boat Mooring Cleat Apparatus — used to releasably secure a boat to a mooring post. The Boat Mooring Line Apparatus comprises a mooring line of a given diameter with several bulges spaced along one end, the bulges having a diameter greater than that of the mooring line, with the opposite end comprising a slip-loop. The cleat includes two substantially parallel spaced apart arched members which between them define an arched slot, that is as wide as the diameter of the mooring line, but narrower than the diameter of any bulge on the line. Both ends of the parallel spaced arched members are transversely registered. A mounting plate is affixed to each pair of ends and is provided for interconnecting the ends, and for securing the ends to the boat. The members are arched so that they rise from the boat, thereafter extend along and spaced from the boat, and then extend back to the boat. Because the slot is narrower than any one of the bulges, the spaced apart members define a stop for at least one of the bulges to prevent removal of the mooring line end from the cleat by a tension force along the line. However, the mooring line can be deliberately removed from the cleat by applying a force normal to the line.

18 Claims, 7 Drawing Figures

BOAT MOORING APPARATUS

BACKGROUND OF THE INVENTION

1. Field of the Invention

The present invention relates to boat mooring devices and particularly to such devices for enabling quick releasable mooring of a boat.

2. Description of the Prior Art

Means for mooring boats to mooring posts therefor have existed ever since mankind realized the ability to float on water. One of the most basic types of boat mooring devices has been the use of a cleat on a boat which functions in conjunction with a mooring line, such as one having a fixed loop at one end thereof which is thrown about the mooring post with the opposite end of the rope secured about the cleat by wrapping the rope around the cleat in a predetermined and well accepted configuration. If done properly, such an arrangement readily succeeds in securely mooring the boat. However, with the advent of the "weekend sailor", a desire for quicker and more easily manageable mooring devices has developed. Examples of such typical prior art mooring devices are disclosed in U.S. Pat. Nos. 750,141; 2,403,057; 2,666,934; 2,912,953; 3,094,755; 3,101,695; 3,224,404; 3,473,505; 3,507,243. These prior art boat mooring devices, however, while simplifying various aspects of the mooring operation, such as by the use of a slip-loop device at one end of the mooring line, have not as yet, to the knowledge of the inventor herein, satisfactorily simplified the complete mooring assembly so as to satisfactorily enable quick releasable mooring of a boat to a mooring post by employing both a slip-loop mooring line and a quick-release and quick-securement cleat. These disadvantages of the prior art are overcome by the present invention.

SUMMARY OF THE INVENTION

A boat mooring apparatus for enabling quick releasable mooring of a boat to a mooring post means is provided in which the apparatus comprises a mooring line having an associated diameter and a plurality of longitudinally spaced apart bulges, such as knots in the line, therealong, the bulges having an associated diameter greater than the mooring line diameter. Means are operatively associated with the mooring line for forming an adjustable size slip-loop at one end of the mooring line with the slip-loop so formed being slippable over the mooring post means and adjustably tightenable thereabout to securely fasten the mooring line to the mooring post means. A boat mountable cleat means is provided which comprises a pair of substantially parallel spaced apart members defining a slot for insertably receiving a portion of the end of the mooring line opposite from the one end therein, in which predetermined slippage in the inserted mooring line is permitted, such as a pair of spaced apart arcuate members defining an arcuate channel comprising the slot. In the instance of the arcuate channel, this channel may comprise an enlarged portion having a diameter greater than the bulge diameter for enabling insertion of the bulge therethrough when the mooring line opposite end portion is inserted in the slot and, moreover, may comprise a removable pin means associated with the enlarged portion which pin is removably insertable behind the inserted bulge for preventing accidental withdrawal of the inserted mooring line opposite end portion from the arcuate channel. In either instance, the slot is narrower in width than the associated diameter of any one of the bulges and the spaced apart members define a stop member for an adjacent one of the bulges of the inserted mooring line end portion for preventing removal of the inserted mooring line end portion from the cleat means by a force along the mooring line while enabling both quick insertion of the mooring line opposite end portion and quick intentional removal of the inserted mooring line opposite end portion from the cleat means slot by a sufficient force substantially normal to the mooring line. Preferably, the slot is substantially equal in width to the mooring line diameter. In addition, the mooring line may comprise a supplemental resilient means, such as a spring, or elastic, such as one connected prior to the location of the bulges or knots for enhancing the quick insertion of the mooring line opposite end portion in the slot while providing an additional bearing force for the adjacent bulge of the inserted mooring line opposite end portion against the stop member in response to the mooring line being pulled taut.

DETAILED DESCRIPTION OF THE PREFERRED EMBODIMENTS

Figure 2:
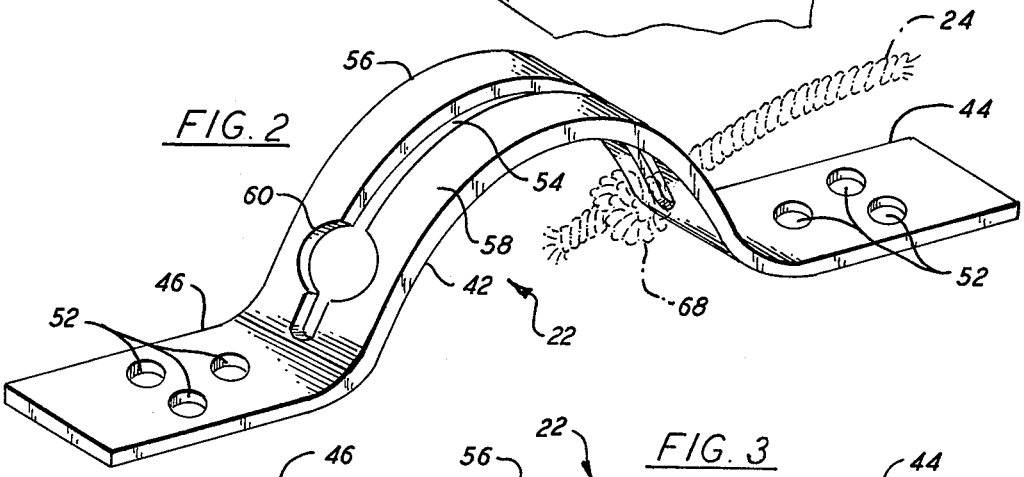
FIG. 2 is a perspective view of the presently preferred embodiment of the cleat portion of the boat mooring apparatus of FIG. 1.
Figure 3:
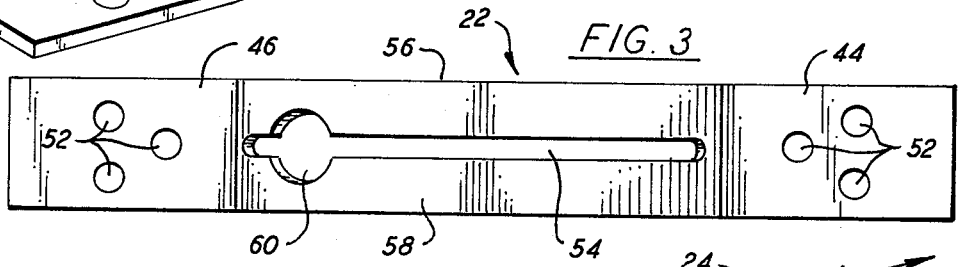
FIG. 3 is a plan view of the cleat illustrated in FIG. 2.
Figure 4:
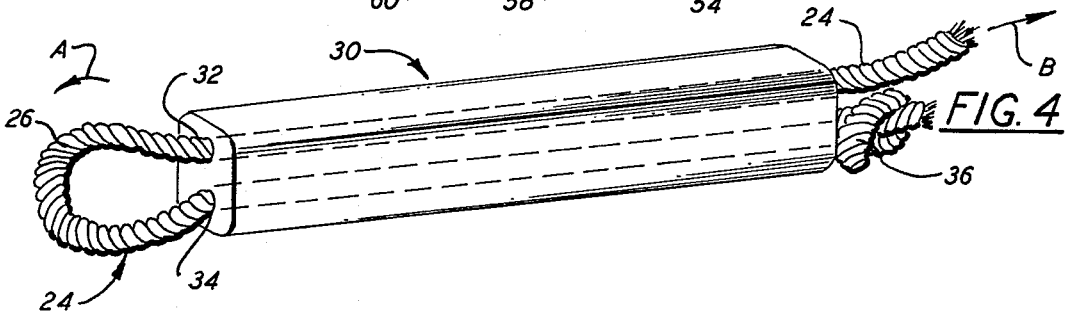
FIG. 4 is a perspective view of the slip-loop of the boat mooring apparatus of FIG. 1.
Figure 7:
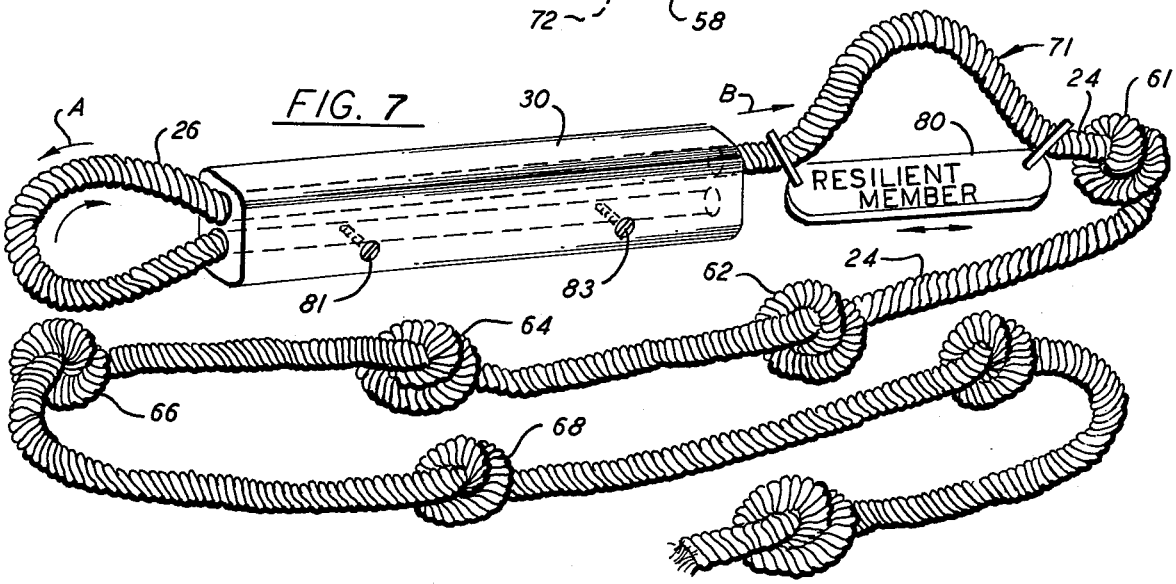
FIG. 7 is a diagrammatic illustration of an alternative embodiment of the mooring line and slip-loop portions of the embodiment illustrated in FIG. 1.

Referring now to the drawings in detail, and initially to FIGS. 1 through 4 thereof, the preferred boat mooring apparatus, generally referred to by the reference numeral 20, of the present invention shall be described. As shown and preferred in FIG. 1, the boat mooring apparatus 20 of the present invention preferably includes a cleat portion 22, a mooring line 24 having a slip-loop 26 at one end thereof, and means 28 for forming the slip-loop 26. With respect to the formation of the slip-loop 26 by means 28, this means 28, as shown in FIG. 4, preferably comprises a pipe like member 30 having a pair of longitudinal channels or apertures 32 and 34 running therethrough. Preferably, the diameter of channel 32 is greater than the diameter of the mooring line 24 passing therethrough so as to enable the mooring line 24 to slidably pass through channel 32 so as to vary the size of the slip-loop 26 formed by such slidable passage of mooring line 24 through channel 32, which line 24 is fastened at the other end in channel 34. Although the mooring line 24 is shown in FIG. 4 as passing through channel 34 and being secured at the end opposite from the slip-loop 26 by means of a bulge or knot 36 so as to prevent the mooring line from being drawn back through channel 34, it is of course understood that any other manner of securement of the end of the mooring line, such as by screwing or gluing the mooring line within pipe 30, such as illustrated in FIG. 7 by screws 81–83, may be accomplished so long as the mooring line 24 is fixed at one end to enable the formation of slip-loop 26 by sliding movement of mooring line 24 through channel 32 of pipe 30 in conventional fashion. Thus, slip-loop 26 will enable the mooring line 24 to be slipped over a mooring post 40 and adjustably tightened thereabout to bring pipe 30 to bear up against mooring post 40 in tight relationship and prevent the slip-loop 26 from inadvertently sliding back over the top of the post 40. Moreover, this tightening effect is enhanced by the normal movements of the moored boat away from the dock. When it is desired to remove the mooring line 24 from mooring post 40, the slip-loop 26 is merely loosened by pulling pipe 30 away from post 40 thereby pulling mooring line 24 through channel 32 so as to enlarge the slip-loop 26 to a diameter greater than the diameter of the mooring post 40, whereupon the slip-loop 26 is then merely lifted back up over the top of mooring post 40.

Figure 1:
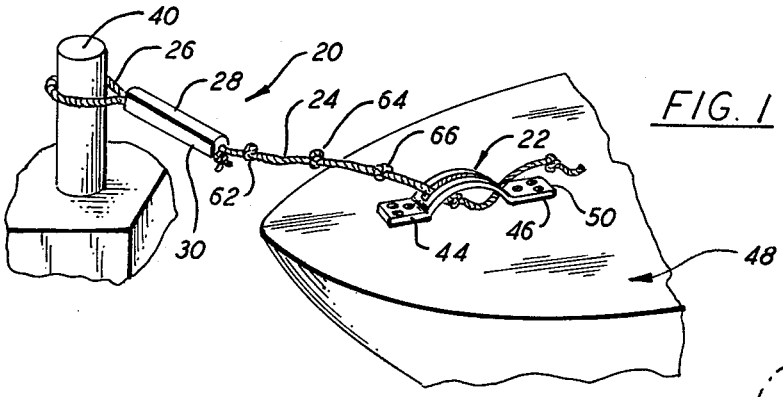
FIG. 1 is a fragmentary diagrammatic illustration of the preferred use of the boat mooring apparatus of the present invention.

With respect to the presently preferred embodiment of the cleat portion 22 of the boat mooring apparatus 20, this cleat portion 22 is shown in greater detail in FIGS. 2 and 3, with FIG. 2 being an enlarged perspective view thereof. As shown and preferred in FIG. 2, cleat 22 most preferably comprises an arcuate portion 42 which preferably terminates in planar portions 44 and 46 at the opposite ends thereof, the arcuate portion 42 preferably forming a semicircular portion. The planar portions 44 and 46 are preferably provided for securely mounting the cleat 22 to the deck 48 of a boat, such as by conventional screws 50 or other fasteners. In order to accomplish this, apertures 52 are provided in the mounting portions 44 and 46, with three such apertures being shown, by way of example, in each mounting portion 44 and 46. The arcuate portion 42 preferably comprises an arcuate channel or slot 54 disposed therein, the arcuate slot 54 being defined by spaced apart portions 56 and 58 of the arcuate portion 42 of the cleat 22. As further shown and preferred in FIG. 2, this arcuate slot 54 preferably includes an enlarged circular portion 60 adjacent one end thereof but preferably spaced upwardly a predetermined distance about the arc defined by slot 54 in order to prevent accidental withdrawal of the mooring line through enlarged portion 60 as will be described in greater detail hereinafter. As shown and preferred, in mounting cleat 22 to the boat deck 48, the enlarged portion 60 is located at the end normally furthest from the mooring post 40. Most preferably, the mooring line 24 contains a plurality of bulges, such as knots, longitudinally spaced therealong, with four such knots 62, 64, 66 and 68 being shown by way of example in FIG. 1. These knots 62 through 68 are preferably spaced at predetermined distances along the mooring line 24 so as to allow for quick releasable mounting of the mooring line 24 to the cleat 22 at variable predetermined distances from the mooring post 40 dependent on the desired amount of slack to remain in mooring line 24. The associated diameter of the various bulges or knots 62 through 68, is preferably equal, and greater in diameter than the associated diameter of the mooring line 24. Furthermore, most preferably, the width of the slot 54 is preferably substantially equal to the diameter of the mooring line in order to essentially require a snug-fit of the mooring line through the slot 54 and the diameter of the enlarged portion 60 is preferably greater in diameter than the diameter of any one of the bulges or knots 62 through 68 so as to enable the passage or entry of the desired knot or bulge 62 through 68 through the enlarged portion 60 when securing or mounting the mooring line 24 to the cleat 22 in order to complete the boat mooring operation, as will be described in greater detail hereinafter. As was previously mentioned, because the diameter of the enlarged portion 60 is greater than the diameter of an associated knot or bulge 62 through 68, this enlarged portion 60 is located at a point spaced upwardly along the arc of the slot 54 so as to prevent accidental withdrawal or exit of the knot 62 through 68 back through the enlarged portion 60 by a force along the mooring line 24.

Now describing the operation of the preferred boat mooring apparatus 20 of the present invention. In employing the presently preferred boat mooring apparatus 20 of the present invention, the user initially insures that the slip-loop 26 is of sufficient size to readily slip over the mooring post 40. This is accomplished by sliding the mooring line 24 through channel 32 in the direction of arrow A (FIG. 4) until the slip-loop 26 so formed is of the desired size. Thereafter, when the boat to be moored is sufficiently close to the dock and/or mooring post 40, the user tosses or slips the slip-loop over the top of the mooring post 40 and thereafter preferably pulls on the mooring line 24 in the opposite direction to arrow A, as indicated by arrow B (FIG. 4), thereby pulling mooring line 24 back through channel 32 so as to tighten the slip-loop about the mooring post 40 to the desired tightness, such as to cause member 30 to substantially bear up against the mooring post 40. Thereafter, depending on the desired slack of the line 24 and the proximity of the boat to be moored to the mooring post 40, the user inserts the knot or bulge corresponding to this desired slack of mooring line 24, for example knot 68 in FIG. 1, through the enlarged opening 60 in slot 54 with the mooring line 24 being urged in a downward direction to insure that the line 24 adjacent the desired bulge or knot 68 is also passed through the slot 54. Thereafter, due to normal movement of the boat being moored, the knot or bulge 68 moves forward to bear up against the inside portion of members 56 and 58 which define slot 54, this inside portion comprising a stop member for knot or bulge 68 since the diameter of the knot 68 is greater than the width of the slot 54. In this regard, it should be noted that the spacing between adjacent knots or bulges 62–64, 64–66, and 66–68, by way of example, may be equal to the longitudinal length of the slot 54 so as to enable ready passage of the selected knot or bulge, 68 by way of example, through the enlarged portion 60 of the slot 54, although such need not be the case.

As previously mentioned, enlarged portion 60 is disposed along the arc of slot 54 upward from the horizontal so as to prevent accidental withdrawal of the knot 68 through the enlarged portion 60 if the boat being moored should move forward a sufficient distance to accidentally enable such withdrawal or exit of knot 68 when mooring line 24 was substantially horizontal. Thus, the boat may quickly be moored by the tossing of the slip-loop over the mooring post 40, which slip-loop may be tightened down merely by pulling on mooring line 24 in the direction of arrow B followed by the subsequent quick insertion of the mooring line 24 in slot 54 of cleat 22 by a downward thrust substantially normal to the mooring line 24 so as to quickly pass the desired knot or bulge 68 through the enlarged portion 60. The boat is then moored via this line 24 without the necessity of tying up the line 24 about a conventional cleat. In order to remove the mooring line 24, the opposite procedure occurs, such as by loosening the slip-loop 26 by pulling pipe 30 away from post 40 thereby pulling mooring line 24 in the direction of arrow A, thereafter lifting slip-loop 26 over and away from mooring post 40, and thereafter pulling mooring line 24 in the upward direction substantially normal to mooring line 24 so as to forceably exit knot or bulge 68 back through enlarged portion 60. Thus, by this arrangement, accidental removal of the inserted mooring line 24 from the cleat 22 by a force along the mooring line 24 is prevented while both quick insertion of the mooring line 24 and quick intentional removal of the inserted mooring line 24 from the slot 54 of the cleat 22 is enabled by application of a sufficient force substantially normal to the mooring line 24.

Figure 5:
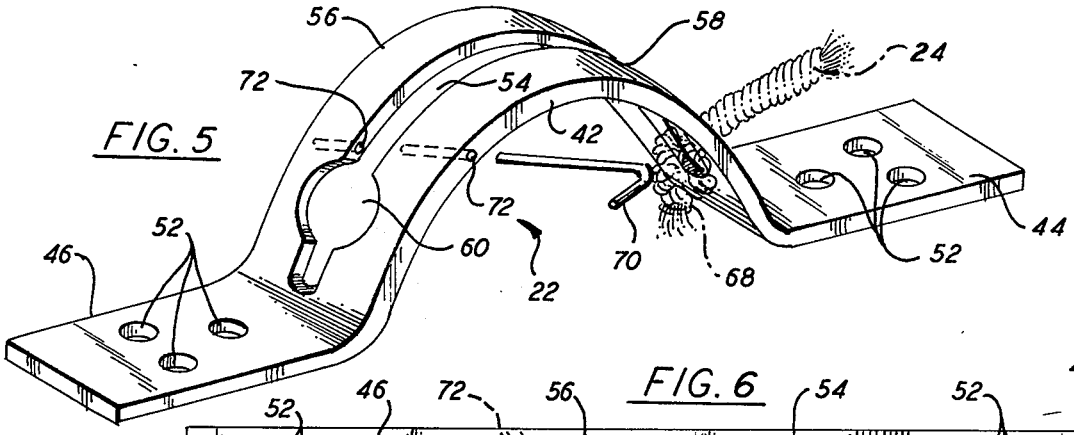
FIG. 5 is a perspective view, similar to FIG. 2, of an alternative embodiment of the cleat illustrated in FIG. 2.
Figure 6:
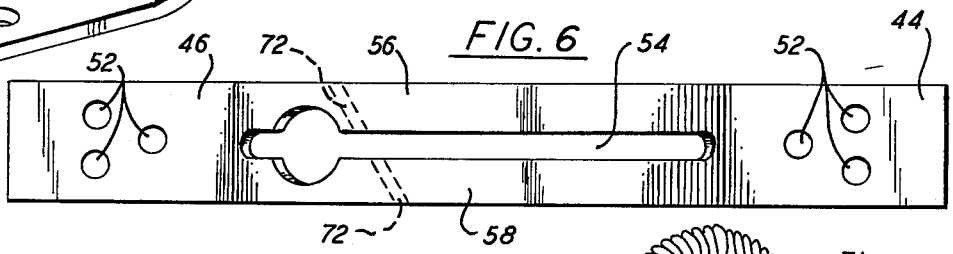
FIG. 6 is a plan view of the cleat illustrated in FIG. 5.

As shown in FIGS. 5 and 6, if desired, added safety to prevent accidental withdrawal or exit of the inserted knot, 68 by way of example, may be provided by providing in the cleat 22 a removable pin 70 which is removably insertable in a passageway 72 which intersects the slot 54 above the enlarged portion 60. Thus, when the knot 68 has been inserted through enlarged portion 60, the pin 70 is then inserted in passageway 72 behind the knot 68 to prevent accidental withdrawal of the mooring line 24. In addition, as shown in FIG. 7, the mooring apparatus 20 may be further enhanced by employing a resilient member 80, such as an elastic band formed of an elastomer, or a spring, located prior to the bulges or knots 61, 62, 64, 66, 68, with line 24 having an arcuate bow 71 therein which is longitudinally spanned by resilient member 80. The longitudinal extent of the resilient member 80 is preferably sufficiently less than the arcuate extent of the mooring line 24 at bow 71 so as to enable resilient member 80 to return the bow 71 to its rest position or arcuate shape when member 80 is longitudinally stretched. In this manner, prior to insertion of the mooring line 24 in the slot 54 in the cleat 22, the line 24 which has been mounted at one end to mooring post 40 may be pulled so as to stretch the resilient member 80 which is preferably held in this stretched or expanded condition as the selected knot or bulge, for example knot 68, is inserted through the enlarged portion 60. Thereafter, when the mooring line is released by the user, the resilient contraction of member 80 will quickly force the knot 68 into bearing relationship against the stop member formed by the inside portion of members 56 and 58 defining slot 54. In addition, as the boat which is moored sways or moves with the tide, the expansion and contraction of resilient member 80 will provide an additional bearing force for the adjacent knot 68 of the inserted mooring line 24 against the aforementioned stop member in response to the mooring line 24 being pulled taut.

As further noted, and as shown in FIG. 7, and as previously mentioned, the end of the mooring line 24 fastened in member 30 may be fastened in any conventional manner, such as by means of screws 81 and 83 shown by way of example in FIG. 7.

Of course, as should be understood, the arrangement illustrated in FIG. 7 may be used with any cleat that has two prong members, or two upstanding members defining a slot.

The advantage of the arched slot arrangement of the cleat 22, is to prevent accidental withdrawal or disengagement of the mooring line from the cleat during the occurrence of a condition of slackness in line 24, while in the instance of just a pair of upstanding prongs, the possibility of accidental withdrawal of the mooring line under slack conditions is greater.

It is to be understood that the above described embodiments of the invention are merely illustrative of the principals thereof, and that numerous modifications and embodiments of the invention may be derived within the spirit and scope thereof.

Various other modifications to the cleat may occur to one of ordinary skill in the art. The arched cleat as illustrated has arcuate members defining an arcuate slot and has a circular aperture. However, the cleat would function with an almost infinite variety of shapes of arches and apertures, so long as the stop members are substantially parallel.

Therefore, the words "concave" and "convex" in the claims are not intended to restrict the arches to only curved or arcuate arches. But rather, the word "concave" should indicate that surface of the cleat, excluding the mounting means, which would be seen, if the boat deck as illustrated in FIG. 1 were transparent, and one could look up through it to the cleat. Of course, "convex" means that surface of the cleat, excluding the mounting means, which would be seen by standing on the boat deck and looking straight down at the cleat.

By using a Boat Mooring Cleat Apparatus, and a Boat Mooring Line Apparatus, comprising a Boat Mooring Apparatus, quick releasable mooring of a boat to a mooring post, with a minimum of effort and a maximum of security, may be accomplished.

What is claimed is:

1. A boat mooring apparatus for enabling quick releasable mooring of a boat to a mooring post means, said apparatus comprising a mooring line having an associated diameter and a plurality of longitudinally spaced apart bulges therealong, said bulges having associated diameters greater than said mooring line diameter, means operatively associated with said mooring line for forming an adjustable size slip-loop at one end of said mooring line, said slip-loop being slippable over said mooring post means and adjustably tightenable thereabout to securely fasten said mooring line to said mooring post means, and boat mountable cleat means comprising a pair of substantially parallel spaced apart arched members comprising a convex and a concave side defining an arched slot for insertably receiving a portion of the end of said mooring line opposite from said one end therein, said arched slot being narrower in width than said associated diameter of any one of said bulges, said spaced apart arched members defining a stop member on the concave sides of said arched members for an adjacent one of said bulges of said inserted mooring line opposite end portion for preventing removal of said inserted mooring line opposite end portion from said cleat means by a force along said mooring line while enabling both quick insertion of said mooring line opposite end portion and quick intentional removal of said inserting mooring line opposite end portion from said cleat means arched slot by a sufficient force substantially normal to said mooring line, each pair of ends of said arched members being in transverse registration, means to interconnect each pair of ends and to mount each said interconnected pair of ends on a support, said arched members being configured to extend away from the support adjacent to each pair of ends and thereafter to extend along and spaced from said support, both arched members being configured to extend back to the support, said spaced apart arched members also defining an aperture, which aperture is spaced away from the longitudinal center of said arched members, for insertion of a bulge along said opposite end portion of said mooring line, the diameter of said aperture being slightly larger than the associated diameters of said bulges, mounting means adjacent to said pair of ends closest to said aperture intended to be fastened to said support such that said aperture is positioned further away from said mooring post means than said pair of ends remote from said aperture, said arched slot enabling a predetermined slippage of said inserted mooring line within said arched slot dependent upon the longitudinal extent between the pair of ends remote from said aperture and said aperture.

2. A boat mooring apparatus in accordance with claim 1 wherein said arched slot is substantially equal in width to said mooring line diameter.

3. A boat mooring apparatus in accordance with claim 1 wherein said bulges comprise knots in said mooring line.

4. A boat mooring apparatus in accordance with claim 1 wherein said mooring line further comprises supplemental resilient means for providing an additional bearing force for said adjacent bulge of said inserted mooring line opposite end portion against said stop member in response to said mooring line being pulled taut.

5. A boat mooring apparatus in accordance with claim 1 wherein said spaced apart arched members comprise arcuate members defining an arcuate channel comprising said slot.

6. A boat mooring apparatus in accordance with claim 1 wherein said cleat means further comprises a removable pin means associated with said slot removably insertable adjacent said inserted bulge for preventing accidental withdrawal of said inserted mooring line opposite end portion from said slot.

7. A boat mooring apparatus in accordance with claim 6 wherein said removable pin means is retainable adjacent said inserted bulge as a result of gravitational force.

8. A boat mooring cleat apparatus in accordance with claim 1 wherein at least one portion of said spaced apart arched members comprise straight sections, defining a straight channel comprising said slot.

9. A boat mooring cleat apparatus in accordance with claim 1 wherein said aperture is spaced away from a pair of ends of said arched members.

10. A boat mooring cleat apparatus for enabling quick releasable mooring of a boat to a mooring post means by a mooring line having an associated diameter and a plurality of longitudinally spaced apart bulges therealong, said bulges having associated diameters greater than said mooring line diameter, said cleat apparatus comprising a pair of substantially parallel spaced apart arched members comprising a convex and a concave side defining an arched slot for insertably receiving a portion of one end of said mooring line, said arched slot being narrower in width than said associated diameter of any one of said bulges, said spaced apart arched members defining a stop member on the concave sides of said arched members for an adjacent one of said bulges of said inserted mooring line end portion for preventing removal of said inserted mooring line end portion from said cleat apparatus by a force along said mooring line while enabling both quick insertion of said mooring line end portion and quick intentional removal of said inserted mooring line end portion from said arched slot by a sufficient force substantially normal to said mooring line, each pair of ends of said arched members being in transverse registration, means to interconnect each pair of ends and to mount each said interconnected pair of ends on a support, said arched members being configured to extend away from the support adjacent to each pair of ends and thereafter to extend along and spaced from said support, both arched members being configured to extend back to the support, said spaced apart arched members also defining an aperture, which aperture is spaced away from the longitudinal center of said arched members, for insertion of a bulge along said mooring line, the diameter of said aperture being slightly larger than the associated diameters of said bulges, mounting means adjacent to said pair of ends closest to said aperture intended to be fastened to said support such that said aperture is positioned further away from said mooring post means than said pair of ends remote from said aperture, said arched slot enabling a predetermined slippage of said inserted mooring line within said arched slot dependent upon the longitudinal extent between the pair of ends remote from said aperture and said aperture.

11. A boat mooring cleat apparatus in accordance with claim 10 wherein said arched slot is substantially equal in width to said mooring line diameter.

12. A boat mooring cleat apparatus in accordance with claim 10 further comprising a removable pin means associated with said arched slot removably insertable behind said inserted bulge for preventing accidental withdrawal of said inserted mooring line end portion from said arched slot.

13. A boat mooring cleat apparatus in accordance with claim 12 wherein said removable pin means is retainable as a result of gravitational force.

14. A boat mooring cleat apparatus in accordance with claim 10 wherein said spaced apart arched members comprise arcuate members defining an arcuate channel comprising said slot.

15. A boat mooring cleat apparatus in accordance with claim 10 wherein at least one portion of said spaced apart arched members comprise straight sections defining a straight channel comprising said slot.

16. A boat mooring cleat apparatus in accordance with claim 10 wherein said aperture is spaced away from a pair of ends of said arched members.

17. A boat mooring line apparatus for enabling quick releasable mooring of a boat to a mooring post means, by means of a boat mountable cleat means comprising a pair of substantially parallel spaced apart arched members comprising a convex and a concave side defining an arched slot for insertably receiving a portion of one end of said mooring line, said arched slot having an associated width, said mooring line apparatus comprising a mooring line having an associated diameter and a plurality of longitudinally spaced apart bulges therealong, said bulges having associated diameters greater than both said mooring line diameter and said arched slot width, means operatively associated with said mooring line for forming an adjustable size slip-loop at the end of said mooring line opposite from said slot insertable mooring line one end, said slip-loop being slippable over said mooring post means and adjustably tightenable thereabout to securely fasten said mooring line to said mooring post means, an adjacent one of said bulges of said inserted mooring line one end portion being stoppable against the concave sides of said spaced apart arched members for preventing removal of said inserted mooring line one end portion from said cleat means by a force along said mooring line while enabling both quick insertion of said mooring line one end portion and quick intentional removal of said inserted mooring line one end portion from said cleat means slot by a sufficient force substantially normal to said mooring line, each pair of ends of said arched members being in transverse registration, means to interconnect each pair of ends and to mount each said interconnected pair of ends on a support, said arched members being configured to extend away from the support adjacent to each pair of ends and thereafter to extend along and spaced from said support, both arched members being configured to extend back to the support, said spaced apart arched members also defining an aperture, which aperture is spaced away from the longitudinal center of said arched members, for insertion of a bulge along said one end portion of said mooring line, the diameter of said aperture being slightly larger than the associated diameters of said bulges, mounting means adjacent to said pair of ends closest to said aperture intended to be fastened to said support such that said aperture is positioned further away from said mooring post means than said pair of ends remote from said aperture, said arched slot enabling a predetermined slippage of said inserted mooring line within said arched slot dependent upon the longitudinal extent between the pair of ends remote from said aperture and said aperture.

18. A boat mooring cleat apparatus in accordance with claim 17 wherein said aperture is spaced away from a pair of ends of said arched members.

* * * * *